US012018427B2

(12) United States Patent
Jang et al.

(10) Patent No.: US 12,018,427 B2
(45) Date of Patent: Jun. 25, 2024

(54) CLOTHES DRYER

(71) Applicant: Samsung Electronics Co., Ltd., Suwon-si (KR)

(72) Inventors: Jonghyun Jang, Suwon-si (KR); Seungwan Yoo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 792 days.

(21) Appl. No.: 17/126,999

(22) Filed: Dec. 18, 2020

(65) Prior Publication Data

US 2021/0189635 A1 Jun. 24, 2021

(30) Foreign Application Priority Data

Dec. 20, 2019 (KR) ..... 10-2019-0172405

(51) Int. Cl.
*D06F 58/20* (2006.01)
*D06F 58/24* (2006.01)
*D06F 58/26* (2006.01)

(52) U.S. Cl.
CPC ..... *D06F 58/206* (2013.01); *D06F 58/24* (2013.01); *D06F 58/26* (2013.01)

(58) Field of Classification Search
CPC ..... D06F 58/206; D06F 58/24; D06F 58/26; D06F 58/28; D06F 39/12; D06F 58/263
See application file for complete search history.

(56) References Cited

U.S. PATENT DOCUMENTS

| | | | | |
|---|---|---|---|---|
| 7,121,018 | B2 | 10/2006 | Lee | |
| 8,495,822 | B2 | 7/2013 | Kim et al. | |
| 9,702,080 | B2 | 7/2017 | Lee et al. | |
| 2016/0289881 | A1 | 10/2016 | Song et al. | |
| 2017/0342641 | A1 | 11/2017 | Zhu et al. | |
| 2017/0343272 | A1* | 11/2017 | Miao | F25D 21/14 |
| 2018/0171537 | A1* | 6/2018 | Lee | B08B 3/14 |

FOREIGN PATENT DOCUMENTS

| | | | |
|---|---|---|---|
| JP | 2017-506084 | A | 3/2017 |
| KR | 10-2006-0115171 | A | 11/2006 |
| KR | 10-1021778 | B1 | 3/2011 |
| KR | 10-1181772 | B1 | 9/2012 |
| KR | 10-2014-0121003 | A | 10/2014 |
| KR | 10-1542389 | B1 | 8/2015 |

OTHER PUBLICATIONS

International Search Report dated Apr. 8, 2021 in connection with International Patent Application No. PCT/KR2020/017998, 2 pages.

* cited by examiner

*Primary Examiner* — Jessica Yuen

(57) ABSTRACT

Disclosed is a clothes dryer including a main body, a drum accommodating an object to be dried and configured to be rotatable in the main body, a heat exchanger configured to heat exchange air introduced from the drum, and a base disposed below the drum to mount the heat exchanger thereon. The base includes a guide side wall extending along a flow direction of the air, and a discharge port configured to discharge condensed water generated in the heat exchanger to a sump. The discharge port is provided on one side of the guide side wall to prevent air from leaking into the discharge port.

20 Claims, 6 Drawing Sheets

CLOTHES DRYER

CROSS-REFERENCE TO RELATED APPLICATION

This application is based on and claims priority under 35 U.S.C. § 119 to Korean Patent Application No. 10-2019-0172405 filed on Dec. 20, 2019 in the Korean Intellectual Property Office, the disclosure of which is incorporated by reference herein in its entirety.

BACKGROUND

1. Field

The disclosure relates to a clothes dryer with an improved base structure.

2. Description of the Related Art

In general, a clothes dryer is a device that dries wet laundry accommodated in a drum by forcibly blowing hot air into the drum. Clothes dryers may be classified into condensation type dryers and exhaust type dryers.

The condensation type dryer dries laundry through circulation of air in which humid air generated from laundry in a drum is dried through a heat exchanger and then the dried air is sent back to the drum. This condensation type dryer does not require a separate exhaust duct, and thus may be simply installed.

Condensed water may be generated in the process of removing moisture from humid air through a heat exchanger. The clothes dryer includes a discharge structure for discharging condensed water to the outside.

However, in such a discharge structure, because the flow direction of humid air in the clothes dryer and the discharge direction of condensed water are the same, the humid air may leak to the outside through the condensed discharge structure. This may affect the humidity around the clothes dryer.

SUMMARY

It is an aspect of the disclosure to provide a clothes dryer in which humid air in the clothes dryer does not leak to the outside by improving the structure of a base.

Additional aspects of the disclosure will be set forth in part in the description which follows and, in part, will be obvious from the description, or may be learned by practice of the disclosure.

In accordance with an aspect of the disclosure, a clothes dryer includes a main body, a drum accommodating an object to be dried and configured to be rotatable in the main body, a heat exchanger configured to heat exchange air introduced from the drum, and a base disposed below the drum to mount the heat exchanger thereon, wherein the base includes a guide side wall extending along a flow direction of the air, and a discharge port configured to discharge condensed water generated in the heat exchanger to a sump, and wherein the discharge port is provided on one side of the guide side wall to prevent air from leaking into the discharge port.

The base may include a body on which the discharge port is formed, and a mounting plate seated on a portion of the body to support the heat exchanger.

The mounting plate may include at least one discharge hole formed to discharge condensed water generated in the heat exchanger to a lower portion of the mounting plate.

The body may include a plurality of inclined surfaces provided below the mounting plate to guide the condensed water passed through the at least one discharge hole to the discharge port.

The plurality of inclined surfaces may include a first inclined surface inclined in a first direction, and a second inclined surface inclined in a second direction opposite to the first direction to join the first inclined surface, and the first inclined surface and the second inclined surface may be inclined in a third direction in which the discharge port is formed to guide the discharge of the condensed water to the discharge port.

The body may include a transverse partition wall extending from the body toward the drum to partition a space in which the condensed water is accommodated.

The transverse partition wall may include a groove formed by being cut to distribute the pressure of air acting on the discharge port.

The mounting plate may include at least one rib extending to the lower portion of the mounting plate to interrupt the flow of air passed through the at least one discharge hole.

The at least one rib may be spaced apart from the body by a predetermined distance so that the condensed water flows.

The at least one rib may extend in a direction perpendicular to the flow direction of air.

In accordance with another aspect of the disclosure, a clothes dryer includes a main body, a drum accommodating an object to be dried and configured to be rotatable in the main body, a heat exchanger configured to heat exchange air introduced from the drum, and a base disposed below the drum to accommodate various components, wherein the base comprises a plurality of inclined surfaces guiding condensed water generated in the heat exchanger, and a discharge port opened to discharge the condensed water, and wherein the discharge port is formed such that a direction in which the condensed water passes through the discharge port is different from a direction in which an airflow passes through the heat exchanger.

The plurality of inclined surfaces may include a first inclined surface inclined in a first direction, and a second inclined surface inclined in a second direction opposite to the first direction.

The base may include a valley formed at a point where the first slope and the second slope join, and the first inclined surface and the second inclined surface may be inclined in a third direction toward the discharge port.

The condensed water may be guided to the discharge port along the valley.

The base may include a mounting plate seated on the plurality of inclined surfaces to support the heat exchanger.

The mounting plate may include at least one discharge hole formed to discharge condensed water generated in the heat exchanger to a lower portion of the mounting plate.

The mounting plate may include at least one rib provided perpendicular to a flow direction of air to interrupt the flow of the air passed through the at least one discharge hole.

The at least one rib may extend to the lower portion of the mounting plate and is spaced apart from the base by a predetermined distance so that the condensed water flows.

The base may include a transverse partition wall extending from the body toward the drum to partition a space for collect the condensed water.

The transverse partition wall may include a groove formed by being cut to distribute the pressure of air acting on the discharge port.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 6, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations shown in the embodiments and the drawings described in the present specification are only the preferred embodiments of the present disclosure, and thus it is to be understood that various modified examples, which may replace the embodiments and the drawings described in the present specification, are possible when filing the present application.

Like reference numbers or signs in the various figures of the application represent parts or components that perform substantially the same functions.

The terms used herein are for the purpose of describing the embodiments and are not intended to restrict and/or to limit the disclosure. For example, the singular expressions herein may include plural expressions, unless the context clearly dictates otherwise.

The terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that although the terms first, second, etc. may be used herein to describe various components, these components should not be limited by these terms, and the terms are only used to distinguish one component from another.

For example, without departing from the scope of the disclosure, the first component may be referred to as a second component, and similarly, the second component may also be referred to as a first component. The term "and/or" includes any combination of a plurality of related items or any one of a plurality of related items.

The terms "front," "rear," "upper portion," "lower portion," "upper end" and "lower end" used in the following description are defined with reference to the drawings, and the shape and position of each component are not limited by these terms.

Hereinafter, embodiments of the disclosure will be described in detail with reference to the accompanying drawings.

Figure 1:
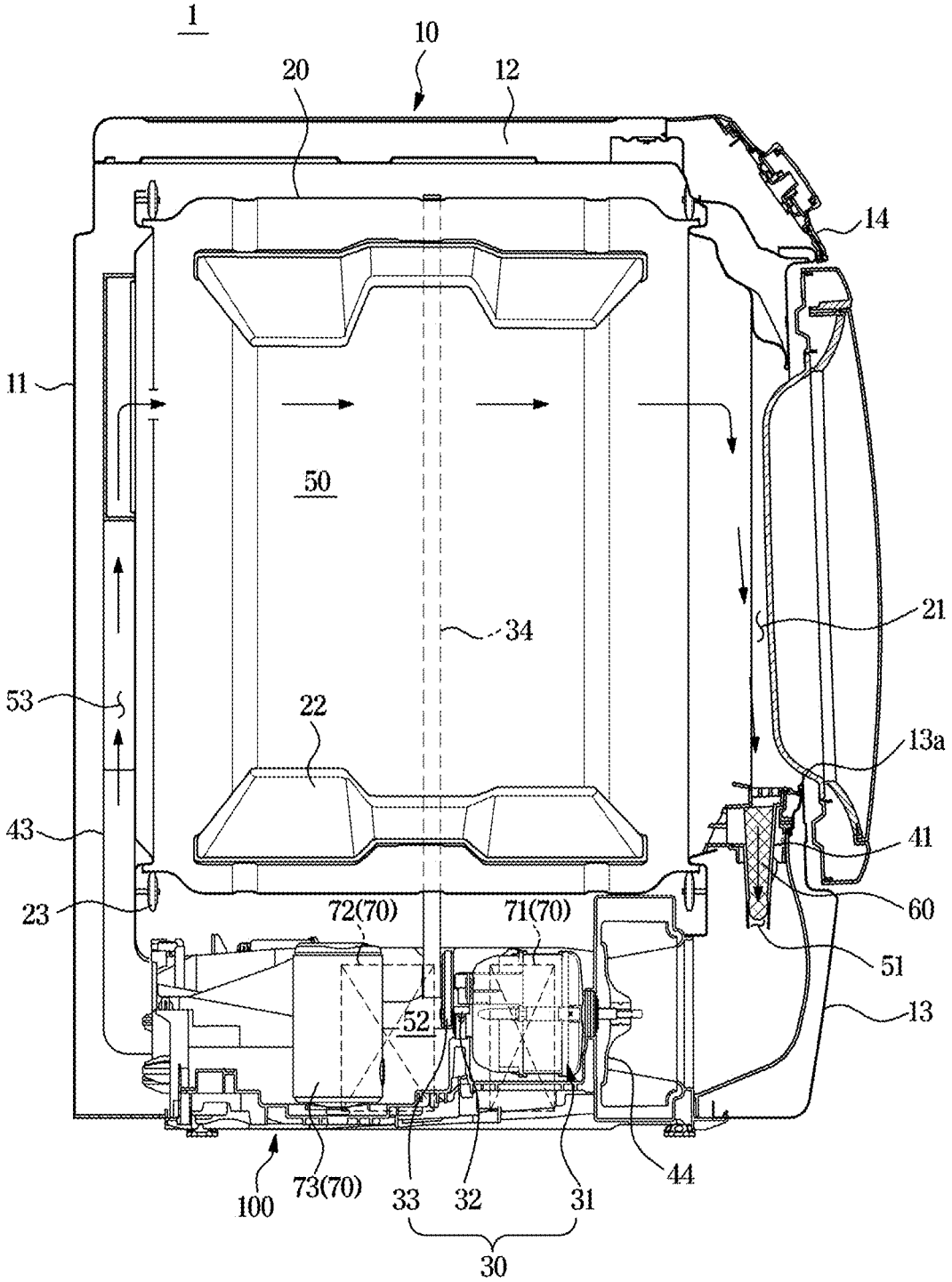
FIG. 1 is a cross-sectional view of a clothes dryer according to an embodiment of the disclosure.

FIG. 1 is a cross-sectional view of a clothes dryer according to an embodiment of the disclosure.

As illustrated in FIG. 1, a clothes dryer 1 may include a main body 10 and a drum 20 rotatably provided in the main body 10.

The main body 10 may include an upper plate 12, a left plate (not shown), a right plate (not shown), a front plate 13, a rear plate 11, and a base 100. An embodiment of the disclosure illustrates that the front plate 13, the upper plate 12, the left plate, the right plate, etc. forming the main body 10 are separately provided and assembled, but the disclosure is not limited thereto. For example, at least some of the front plate 13, the upper plate 12, the left plate, the right plate, etc. of the main body 10 may be integrally formed.

The front plate 13 of the main body 10 is provided with an inlet 13*a* for allowing clothes, which is an object to be dried, to be put in or taken out of the drum 20. The inlet 13*a* may be opened and closed by a door. A control panel 14 configured to control the operation of the clothes dryer 1 may be provided at an upper portion of the body 10.

The drum 20 may be provided inside the main body 10 to accommodate the object to be dried. An opening 21 corresponding to the inlet 13*a* may be formed on a front surface of the drum 20. The opening 21 may also be opened and closed by a door. Inside the drum 20, a plurality of lifters 22 may be disposed along a circumferential direction of the drum 20. The lifter 22 raises and drops the object to be dried so that the object to be dried may be effectively dried. A roller 23 may be provided on an outer circumferential surface of the drum 20 to support the drum 20 to rotate smoothly.

The clothes dryer 1 may include a driving device 30 configured to drive the drum 20. The driving device 30 may include a driving motor 31 mounted on the base 100. The driving motor 31 may include a pulley 33 and a belt 34. The pulley 33 may be connected to a rotation shaft 32 connected to the driving motor 31. When the rotation shaft 32 is rotated by the driving motor 31, the pulley 33 may also rotate together with the rotation shaft 32. The belt 34 may connect the pulley 33 and the drum 20 to transmit the rotation of the pulley 33 to the drum 20.

The clothes dryer 1 may circulate air to dry the object to be dried inside the drum 20. The main body 10 may include a duct 40 configured to form a circulation passage for removing humid air in the drum 20 from the drum 20 and supplying dry air to the drum 20.

The duct 40 may include an inlet duct 41 to introduce humid air in the drum 20 into the duct 40, an outlet duct 43 to discharge hot air to the drum 20, and a connection duct 42 to connect the inlet duct 41 and the outlet duct 43.

A circulation passage 50 through which air flows in the duct 40 may be formed. The circulation passage 50 may include an inlet passage 51, a connection passage 52, and an outlet passage 53. The inlet passage 51 may be formed by the inlet duct 41 provided to introduce air passed through the inside of the drum 20. The connection passage 52 may be connected to the outlet passage 53. The connection passage 52 may be formed by the connection duct 42 connecting the inlet duct 41 and the outlet duct 43. The outlet passage 53 may be connected to the connection passage 52. The outlet passage 53 may be formed by the outlet duct 43 for discharging hot air to the drum 20.

The inlet duct 41 may be disposed at a lower portion of the front surface of the drum 20. The outlet duct 43 may be disposed at a rear of the drum 20. The connection duct 42 may be disposed below the drum 20. The connection duct 42 may be installed on the base 100.

Hot and dry air may be supplied into the drum 20 through the outlet duct 43 disposed at the rear of the drum 20. The object to be dried inside the drum 20 may be dried by the hot and dry air. The air that has dried the object to be dried may become hot and humid. The hot and humid air in the drum 20 may be discharged below the drum 20 through the inlet duct 41.

A filter 60 may be installed in the inlet duct 41. The filter 60 may filter out foreign substances such as lint contained in the air passed through the drum 20. Air filtered by the filter 60 may be discharged into the drum 20 through the connection duct 42 and the outlet duct 43.

Hot and humid air in the drum 20 is introduced into heat exchangers 71 and 72 along the inlet passage 51 in the inlet duct 41. The air that has been heated and dried through the heat exchangers 71 and 72 (see FIG. 2) may be circulated by being discharged into the drum 20 again along the outlet passage 53 in the outlet duct 43. The air circulation as above may be induced by a blowing fan 44 installed on the inlet passage 51 side.

The clothes dryer 1 may include the blowing fan 44. The blowing fan 44 generates a circulation airflow in which hot and humid air in the drum 20 is introduced into the circulation passage 50 and hot and dry air passed through the heat exchangers 71 and 72 is discharged to the drum 20. The blowing fan 44 may be driven together by the driving motor 31 driving the drum 20, but the disclosure is not limited thereto.

Figure 2:
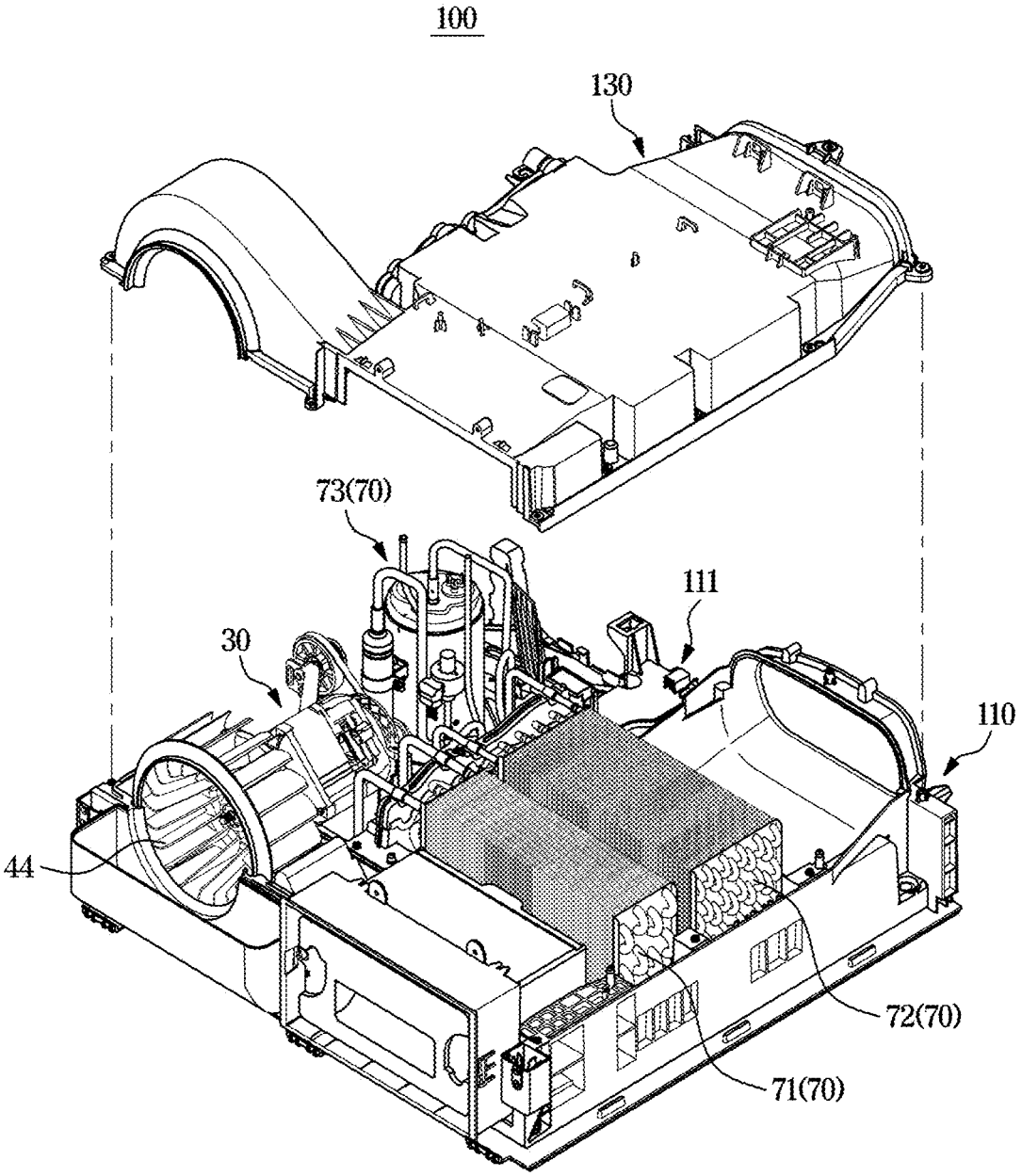
FIG. 2 is an exploded perspective view of a base of the clothes dryer according to an embodiment of the disclosure.

FIG. 2 is an exploded perspective view of a base of the clothes dryer according to an embodiment of the disclosure.

As illustrated in FIG. 2, the clothes dryer 1 may include the base 100. The base 100 may be disposed below the drum 20 to accommodate various components. The heat exchanger 71 and 72, the driving device 30, and the blowing fan 44 may be accommodated and mounted in the base 100.

The base 100 may include a body 110 and a mounting plate 120 supporting the heat exchangers 71 and 72. The base 100 may include a cover 130 configured to form a passage through which air flows. The cover 130 may cover a dehumidifying unit 70 and the blowing fan 44. A portion of the cover 130 may form the connection duct 42. The circulation passage 50 through which air flows may be formed in the cover 130.

The dehumidifying unit 70 may include the evaporator 71, the condenser 72, and a compressor 73. The heat exchangers 71 and 72 may include the evaporator 71 and the condenser 72. Also, although not shown, the dehumidifying unit 70 may further include an expansion valve.

Hot and humid air discharged from the drum 20 is introduced into the heat exchangers 71 and 72 through the blowing fan 44. The hot and humid air may first pass through the evaporator 71 of the dehumidifying unit 70. A refrigerant that absorbs heat by expanding due to a pressure drop may flow inside the evaporator 71. The refrigerant absorbs heat while evaporating in the evaporator 71, and the hot and humid air passing through the evaporator 71 loses moisture while cooling and becomes cold and dry air. That is, the hot and humid air discharged from the drum 20 turns into cold and dry air while passing through the evaporator 71.

The cold and dry air passed through the evaporator 71 may pass through the condenser 72. The refrigerant compressed and overheated by the compressor 73 may flow inside the condenser 72. The overheated refrigerant releases heat while flowing through the condenser 72, and the cold and dry air passing through the condenser 72 is heated to become hot and dry air. That is, the cold and dry air passed through the evaporator 71 turns into hot and dry air while passing through the condenser 72.

When a drying process starts, the driving motor 31 operates, thereby operating the drum 20 and the blowing fan 44. The blowing fan 44 generates a flow of air. The air becomes hot and dry air while passing through the evaporator 71 and the condenser 72 and may be introduced into the drum 20. The hot and dry air introduced into the drum 20 deprives moisture from the object to be dried accommodated in the drum 20 to dry the object to be dried. At the same time, the hot and dry air turns into hot and humid air. The hot and humid air may be introduced into the heat exchangers 71 and 72 again along the inlet passage 51 to turn into hot and dry air. This hot and dry air may be discharged to the drum 20 again.

Figure 3:
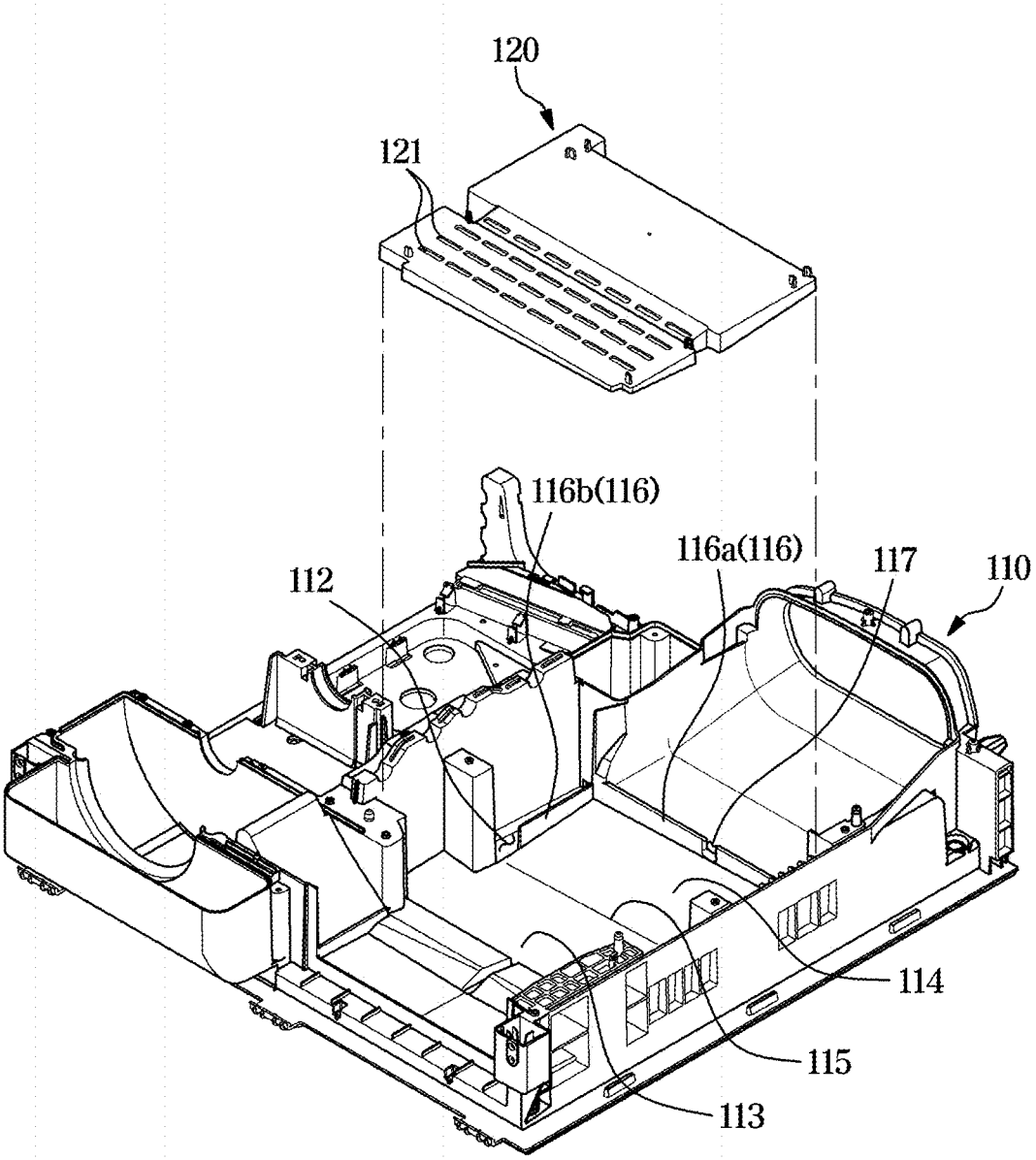
FIG. 3 is an exploded perspective view of a mounting plate and a body of the clothes dryer according to an embodiment of the disclosure.
Figure 4:
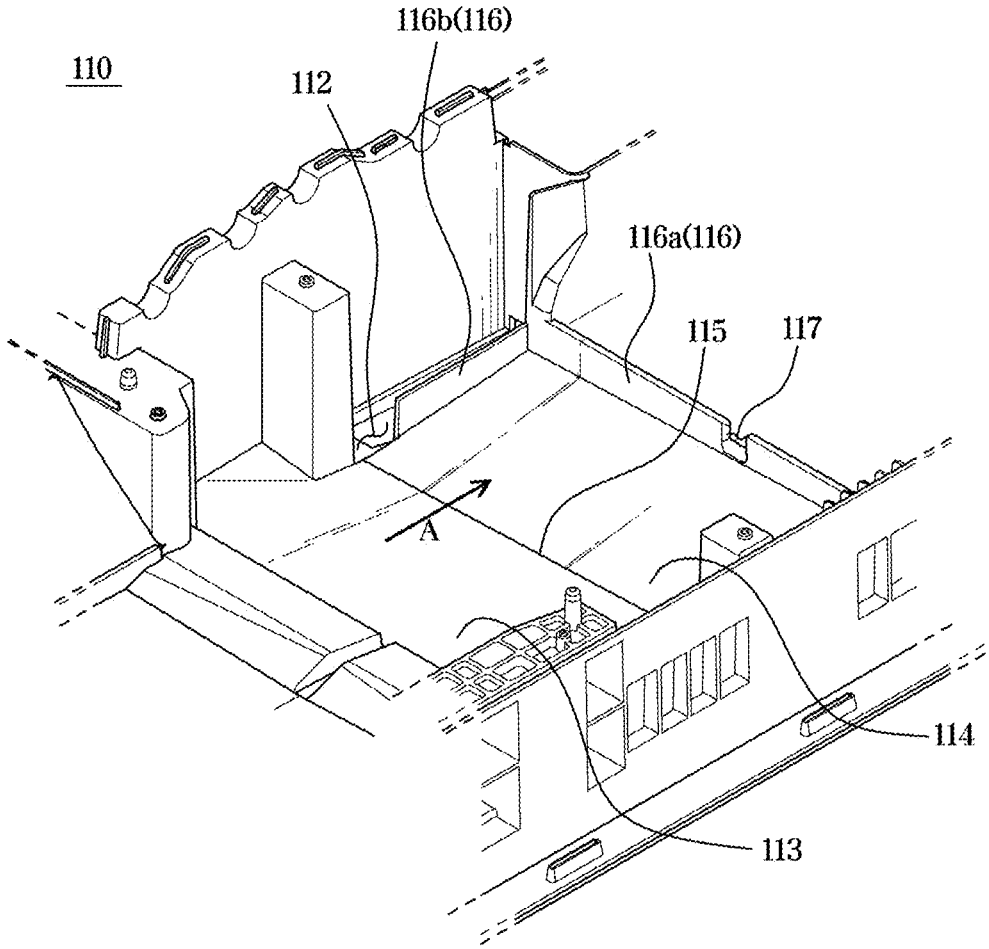
FIG. 4 is an enlarged perspective view of a portion A in FIG. 3.

FIG. 3 is an exploded perspective view of a mounting plate and a body of the clothes dryer according to an embodiment of the disclosure, and FIG. 4 is an enlarged perspective view of a portion A in FIG. 3.

As illustrated in FIGS. 3 and 4, the base 100 may include the body 110 and the mounting plate 120 supporting the heat exchangers 71 and 72.

The mounting plate 120 may be seated on the body 110 to accommodate and support the evaporator 71 and the condenser 72. Condensed water may be generated in the process of discharging moisture while the hot and humid air discharged from the drum 20 is cooled in the evaporator 71. The mounting plate 120 may include at least one discharge hole 121 to allow condensed water to be discharged below the mounting plate 120. Through this, the condensed water generated in the evaporator 71 may be collected in the body 110 below the mounting plate 120 through the discharge hole 121.

The body 110 may include a sump 111 to collect condensed water. The body 110 may include a discharge port 112 provided to allow condensed water to be introduced into the sump 111. The body 110 may include a plurality of inclined surfaces 113 and 114 below the mounting plate 120.

The body 110 may include the plurality of inclined surfaces 113 and 114 provided below the mounting plate 120 to guide the condensed water passed through the discharge hole 121 of the mounting plate 120 to the discharge port 112.

The plurality of inclined surfaces 113 and 114 may include the first inclined surface 113 and the second inclined surface 114. The first inclined surface 113 may be formed to be inclined in a first direction of directing to the second inclined surface 114. The second inclined surface 114 may be formed to be inclined in a second direction of directing to the first inclined surface 113, which is opposite to the first direction. The first inclined surface 113 and the second inclined surface 114 may be formed to be inclined together in a third direction of directing to a place where the discharge port 112 is formed. A valley 115 may be formed at a point where the first inclined surface 113 and the second inclined surface 114 join.

The body 110 may include the discharge port 112 that is open to discharge condensed water to the sump 111. The discharge port 112 may be provided on one side of a guide side wall 116*b*. The guide side wall 116*b* may extend in the direction of airflow. That is, the discharge port 112 may be formed to be open in parallel with the airflow direction of humid air.

The discharge port 112 may be provided at the lowest point of the first inclined surface 113 and the second inclined surface 114. Therefore, the condensed water flowing along the plurality of inclined surfaces may be guided to the discharge port 112 along the valley 115 by gravity. The guided condensed water may pass through the discharge port 112 and be introduced into the sump 111 through a third inclined surface.

In addition to condensed water, humid air may be introduced into a lower portion of the mounting plate 120 through the discharge hole 121 of the mounting plate 120. The flow direction of air may be formed in a direction A by the blowing fan 44. As described above, because the discharge port 112 is formed parallel to the flow direction of air, humid air does not easily pass through the discharge port 112.

Therefore, by the formation structure of the discharge port 112 as above, humid air may not be discharged to the outside of the clothes dryer 1 through the discharge port 112. In addition, the humidity outside the clothes dryer 1 may be kept relatively constant.

The body 110 may include a partition wall 116. The partition wall 116 may include a transverse partition wall 116*a* and the guide side wall 116*b*.

The guide side wall 116*b* may extend along the airflow direction of humid air. Humid air may flow along the guide side wall 116*b*. The discharge port 112 may be provided on one side of the guide side wall 116*b* in parallel with the guide side wall 116*b*.

The partition wall 116 may extend from the body 110 upwardly of the drum 20 side. The transverse partition wall 116*a* may be formed to partition a space for collecting condensed water.

The body 110 may include a groove 117 formed by being cut on the transverse partition wall 116*a*.

As described above, humid air may pass together through the discharge hole 121 of the mounting plate 120 through which condensed water passes. The humid air passed through the discharge hole 121 flows to the lower portion of the mounting plate 120. The groove 117 may be formed on the transverse partition wall 116*a* to minimize an amount in which the air flowed to the lower portion of the mounting plate 120 leaks to the discharge port 112. Through this, the humid air flowed to the lower portion of the mounting plate 120 may re-join into the circulation passage 50 through the groove 117. Therefore, the condensation recovery rate of the clothes dryer 1 may be increased.

In addition, the pressure of air may be prevented from being concentrated to the discharge port 112 as the discharge port 112 is positioned on the guide side wall 116*b* and the groove 117 is positioned on the transverse partition wall 116*a*. That is, the pressure of air acting on the discharge port 112 may be distributed. Through this, the amount of air of being discharged to the discharge port 112 may be reduced.

Figure 5:
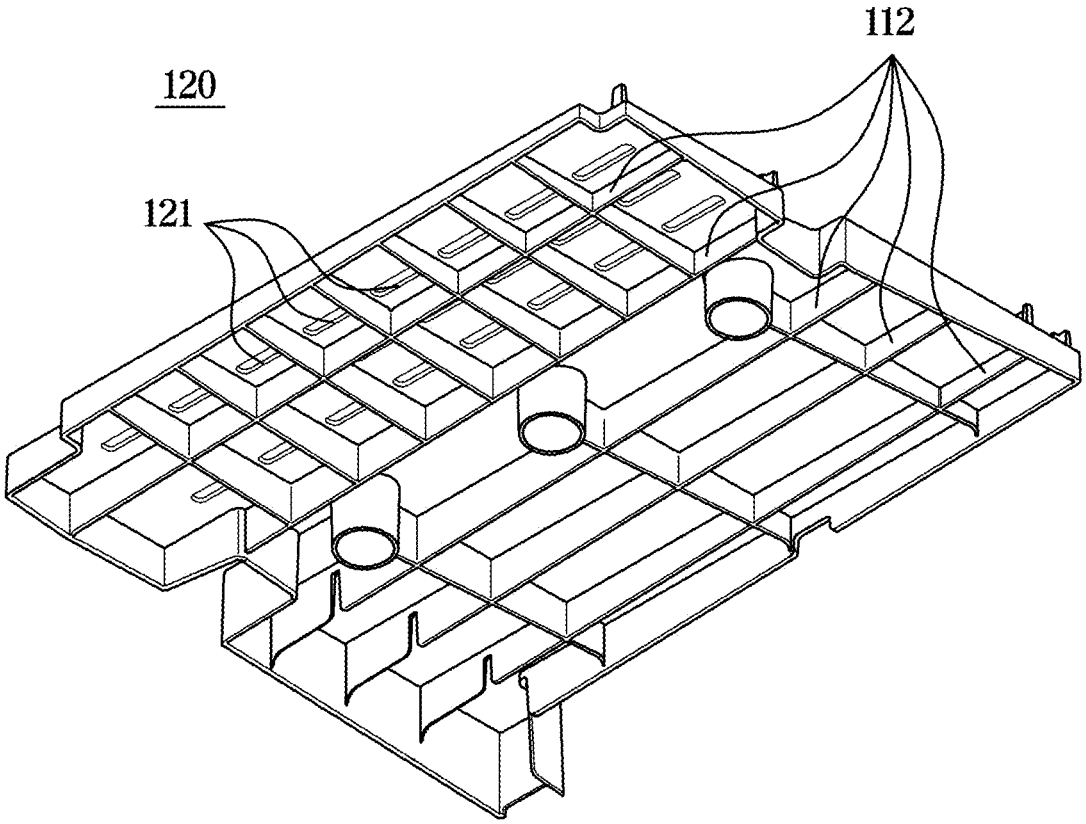
FIG. 5 is a bottom perspective view of the mounting plate of the clothes dryer according to an embodiment of the disclosure.
Figure 6:
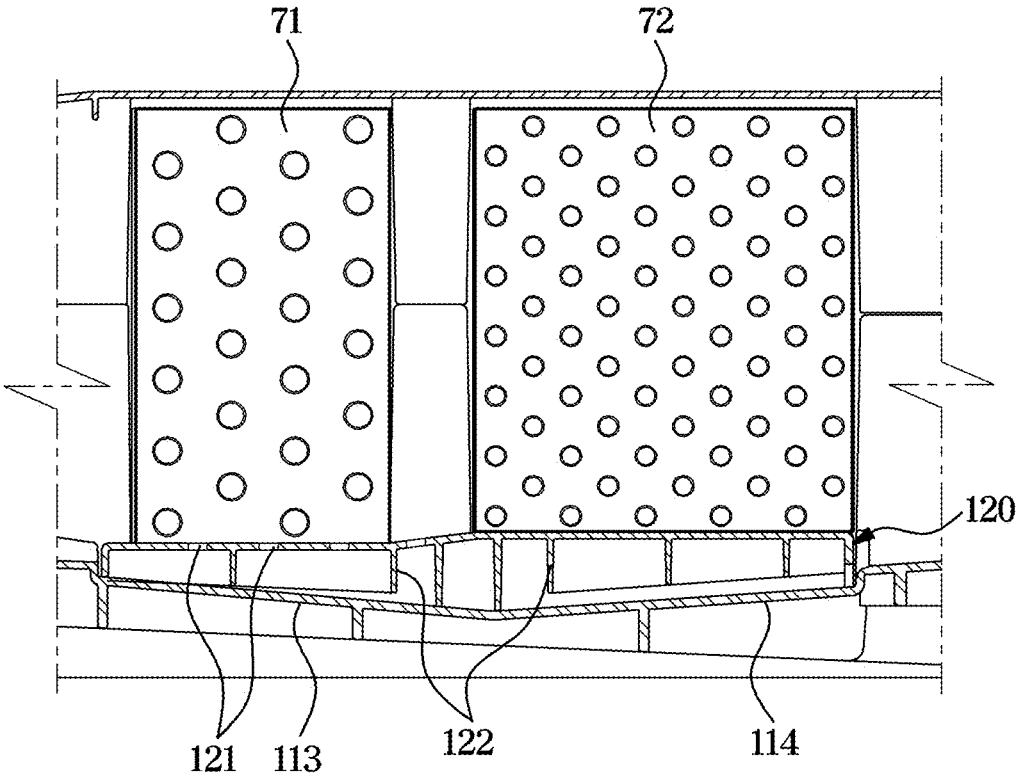
FIG. 6 is an enlarged cross-sectional view of a portion of a base of a clothes dryer according to an embodiment of the disclosure.

FIG. 5 is a bottom perspective view of the mounting plate of the clothes dryer according to an embodiment of the disclosure, and FIG. 6 is an enlarged cross-sectional view of a portion of a base of a clothes dryer according to an embodiment of the disclosure.

As illustrated in FIG. 5, the mounting plate 120 may include at least one rib 122 on a lower surface. The at least one rib 122 may extend downwardly of the mounting plate 120. Also, the at least one rib 122 may be formed to extend in a direction perpendicular to the direction A through which air flows.

The at least one rib 122 may be formed to be spaced apart from the plurality of inclined surfaces 113 and 114 provided below the mounting plate 120 by a predetermined distance in order not to interfere with the flow of condensed water passed through the discharge hole 121 of the mounting plate 120.

Specifically, it may be appropriate that a distance between the at least one rib 122 and the plurality of inclined surfaces 113 and 114 is 5 mm. However, the disclosure is not limited thereto, and the distance may be slightly longer or shorter than 5 mm. Because the distance between the at least one rib 122 and the plurality of inclined surfaces 113 and 114 is formed relatively short, the flow of humid air to the lower portion of the mounting plate 120 may be minimized.

In other words, the at least one rib 122 is formed on the lower surface of the mounting plate 120 to interrupt the flow of humid air passed through the discharge hole 121. In addition, a space between the mounting plate 120 and the body 110 may be formed narrowly to the maximum. Through this, the pressure of air in the lower portion of the mounting plate 120 may increase. Because air moves from a place with a relatively high pressure to a place with a relatively low pressure, by maintaining the pressure of air in the lower portion of the mounting plate 120 at a certain level, a phenomenon in which air is discharged to the lower portion of the mounting plate 120 through the discharge hole 121 may be minimized. Accordingly, the amount of air discharged through the discharge port 112 formed on the body 110 may be reduced, and thus the condensation recovery rate of the clothes dryer 1 may be increased. Therefore, the performance of the clothes dryer 1 may be improved.

As illustrated in FIG. 6, the mounting plate 120 may support the evaporator 71 and the condenser 72. The discharge hole 121 may be formed on the mounting plate 120 corresponding to a lower portion of the evaporator 71. A plurality of inclined surfaces may be formed below the mounting plate 120. The at least one rib 122 may be provided on the lower surface of the mounting plate 120. The rib 122 provided on the lower surface of the mounting plate 120 may be formed to be spaced apart from the plurality of inclined surfaces. Accordingly, while the discharge of condensed water through the spaced apart space is facilitated, the amount of leaked air may be reduced through the structure of the rib 122. Through this, the performance of the clothes dryer 1 may be improved by increasing the condensation recovery rate of the clothes dryer 1.

As is apparent from the above, leakage of humid air in a clothes dryer, which affects the surroundings of the clothes dryer, can be minimized.

Further, the performance of the clothes dryer can be improved by increasing the condensation recovery rate of the clothes dryer.

Although the present disclosure has been described with various embodiments, various changes and modifications may be suggested to one skilled in the art. It is intended that the present disclosure encompass such changes and modifications as fall within the scope of the appended claims.

What is claimed is:

1. A clothes dryer comprising:

a main body;

a drum configured to accommodate an object to be dried and be rotatable in the main body;

a heat exchanger configured to heat exchange air introduced from the drum; and a base disposed below the drum, the heat exchanger mounted to the base, wherein the base comprises a guide side wall extending parallel to a flow direction of the air and a discharge port configured to discharge condensed water generated in the heat exchanger to a sump, and wherein the discharge port extends in a vertical direction from the base and is provided on one side of the guide side wall parallel with an airflow direction of air to prevent air from leaking into the discharge port.

2. The clothes dryer according to claim 1, wherein the base further comprises:

a body on which the discharge port is formed, and a mounting plate seated on a portion of the body and configured to support the heat exchanger.

3. The clothes dryer according to claim 2, wherein the mounting plate comprises at least one discharge hole configured to discharge the condensed water generated in the heat exchanger to a lower portion of the mounting plate.

4. The clothes dryer according to claim 3, wherein the body comprises a plurality of inclined surfaces provided below the mounting plate, the inclined surfaces configured to guide the condensed water passed through the at least one discharge hole to the discharge port.

5. The clothes dryer according to claim 4, wherein:

the plurality of inclined surfaces comprises a first inclined surface inclined in a first direction and a second inclined surface inclined in a second direction opposite to the first direction to join the first inclined surface, and the first inclined surface and the second inclined surface are inclined in a third direction in which the discharge port is formed to guide the discharge of the condensed water to the discharge port.

6. The clothes dryer according to claim 3, wherein the body comprises a transverse partition wall extending from the body toward the drum, the transverse partition wall configured to partition a space in which the condensed water is accommodated.

7. The clothes dryer according to claim 6, wherein the transverse partition wall comprises a groove configured to distribute air pressure acting on the discharge port.

8. The clothes dryer according to claim 3, wherein the mounting plate comprises at least one rib extending to the lower portion of the mounting plate, the at least one rib configured to interrupt the flow of air passed through the at least one discharge hole.

9. The clothes dryer according to claim 8, wherein the at least one rib is spaced apart from the body by a predetermined distance so that the condensed water flows.

10. The clothes dryer according to claim 8, wherein the at least one rib extends in a direction perpendicular to the flow direction of the air.

11. A clothes dryer comprising:

a main body;

a drum configured to accommodate an object to be dried and configured be rotatable in the main body;

a heat exchanger configured to heat exchange air introduced from the drum; and a base disposed below the drum and configured to accommodate various components, wherein the base comprises a guide side wall extending parallel to a flow direction of the air, a plurality of inclined surfaces configured to guide condensed water generated in the heat exchanger, and a discharge port configured to discharge the condensed water, and wherein the discharge port extends in a vertical direction from the base and is provided on one side of the guide side wall parallel with an airflow direction of air to prevent air from leaking into the discharge port, and the discharge port is formed such that a direction in which the condensed water passes through the discharge port is different from a direction in which an airflow passes through the heat exchanger.

12. The clothes dryer according to claim 11, wherein the plurality of inclined surfaces comprises a first inclined surface inclined in a first direction and a second inclined surface inclined in a second direction opposite to the first direction.

13. The doilies dryer according to claim 12, wherein:

the base comprises a valley formed at a point where the first inclined surface and the second inclined surface join; and the first inclined surface and the second inclined surface are inclined in a third direction toward the discharge port.

14. The clothes dryer according to claim 13, wherein the valley is configured to guide the condensed water to the discharge port.

15. The clothes dryer according to claim 11, wherein the base comprises a mounting plate seated on an upper portion of the plurality of inclined surfaces, the mounting plate configured to support the heat exchanger.

16. The clothes dryer according to claim 15, wherein the mounting plate comprises at least one discharge hole configured to discharge condensed water generated in the heat exchanger to a lower portion of the mounting plate.

17. The clothes dryer according to claim 16, wherein the mounting plate comprises at least one rib provided perpendicular to a flow direction of air and configured to interrupt the flow of the air passed through the at least one discharge hole.

18. The clothes dryer according to claim 17, wherein the at least one rib extends to the lower portion of the mounting plate and is spaced apart from the base by a predetermined distance so that the condensed water flows.

19. The clothes dryer according to claim 16, wherein the base comprises a transverse partition wall extending from the body toward the drum and configured to partition a space for collecting the condensed water.

20. The clothes dryer according to claim 19, wherein the transverse partition wall comprises a groove configured to distribute air pressure acting on the discharge port.

* * * * *